US005226179A

United States Patent [19]

Choi

[11] Patent Number: 5,226,179

[45] Date of Patent: Jul. 13, 1993

[54] ANTI-MOIST-TETTER BRIEFS

[76] Inventor: Kichang Choi, Rm, 606, Jugong APT.No, 124, Sanggye 6-Dong, Nowon-Gu, Seoul, Rep. of Korea

[21] Appl. No.: 913,808

[22] Filed: Jul. 16, 1992

[51] Int. Cl.[5] ..... A41B 9/02

[52] U.S. Cl. ..... 2/403; 2/404; 2/405; 2/406; 602/67; 602/70

[58] Field of Search ..... 602/67, 70; 2/403, 404, 2/405, 406

[56] References Cited

U.S. PATENT DOCUMENTS

| | | | |
|---|---|---|---|
| 3,517,666 | 6/1970 | Atlee | 2/403 |
| 4,471,772 | 9/1984 | Miller, Jr. | 2/403 |
| 4,644,945 | 2/1987 | Thorner | 2/403 |
| 4,702,239 | 10/1987 | Ichikawa | 2/403 |
| 5,029,345 | 7/1991 | Angheluta et al. | 2/403 |

FOREIGN PATENT DOCUMENTS

| | | | |
|---|---|---|---|
| 190014 | 5/1957 | Austria | 2/403 |

*Primary Examiner*—Clifford D. Crowder

*Assistant Examiner*—Gloria Hale

*Attorney, Agent, or Firm*—Brady, O'Boyle & Gates

[57] ABSTRACT

Male underwear briefs provides for the separate receptions of the scrotum and the phallus of the wearer in respective separate receptacle means to maintain the groin area dry and clean, thereby preventing various diseases including moist tetter. The briefs of the present invention have a separate scrotum nest made of a net material for resting the scrotum in a non-contact position with the rest of the wearer's body, with a good circulation of air there around, and has a phallus receptacle receiving the phallus in an upright posture and an elastic element fixed inside the phallus receptacle for holding the inserted phallus in an upright position so that the phallus is prevented from contact with adjacent skin areas. This separate receptions of scrotum and phallus prevents the skin to skin contact of the wearer and the net of the scrotum nest improves the circulation of air, thereby preventing an undue moistening of the groin and thus the various diseases arising therefrom.

4 Claims, 1 Drawing Sheet

ANTI-MOIST-TETTER BRIEFS

BACKGROUND OF THE INVENTION

1. Field of the Invention

The present invention relates to male underwear, and more particularly to briefs having means for resting the male organ at a predetermined non-contacting position from the surrounding skin to maintain the wearer's cleaness and prevent moist tetter and the like.

2. Description of the Prior Art

In conventional underwear of men, the briefs are effective to veil the privy parts of the wearer and to absorb some body secretions like sweats. However, these briefs fail to give adequate body conditions to the wearer.

Specifically, under such briefs the scrotum and the phallus of the male organ are always pressed together onto the surrounding skin prohibiting the circulation of air and aggravating the adverse moist condition at the area of the groin especially in hot and humid weather.

This moist condition is bad in a hygienic sense and will cause the moist tetter of the wearer.

There have been attempts to avoid the problem by manufacturing briefs with the use of materials which permit better circulation of air. However, it has been found that such attempts do not provide the essential solution to the problem.

The goal of the present invention is to overcome these drawbacks by providing a structure for briefs with a specialized means for supporting the male organ.

SUMMARY OF THE INVENTION

It is an object of the present invention to provide a male underwear comprising: a main body for enclosing a pelvic part of a male wearer, and a front panel means including a scrotum nest of a porous material at a front lower part of the main body, a phallus receptacle formed above the scrotum nest for receiving the phallus in an upright posture and a transverse elastic band fixed in the phallus receptacle and close to the entrance of the phallus receptacle in order to hold the phallus in an upright position whereby maintaining the phallus and the scrotum of the wearer therein separated from the adjacent skin and allowing sufficient circulation of air at the associated body parts to prevent moist tetter and the like.

According to an embodiment of the present invention, the scrotum nest may be made of a net.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
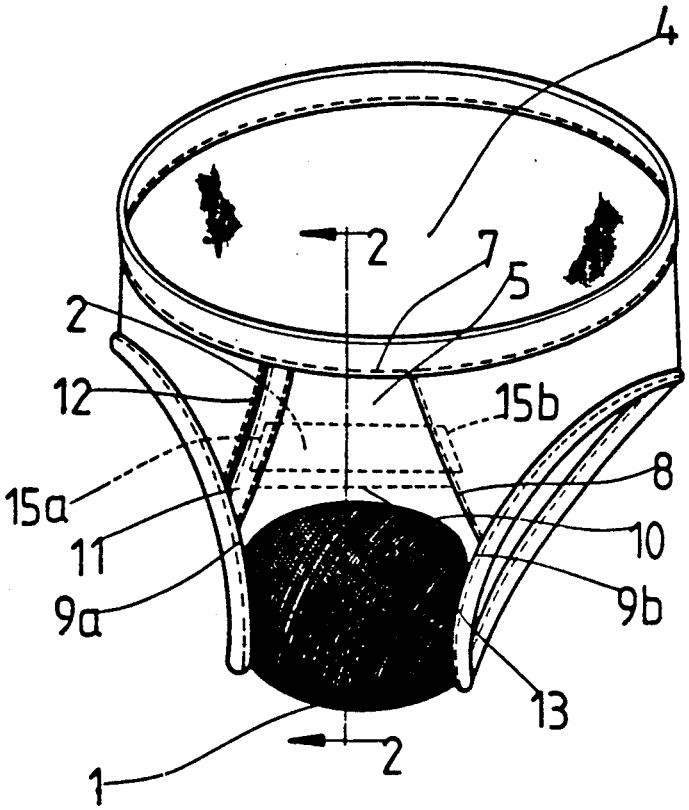
FIG. 1 is a perspective view showing the briefs according to an embodiment of the present invention.

Referring now to FIG. 1 showing an embodiment of the present invention, the briefs 4 is generally constructed as coventional briefs with a body encircling member including a waist band and front and back portions. The front portion has at its lower end a scrotum nest 1 comprised of a net, and a phallus receptacle 3 disposed inside the briefs 4 above the scrotum nest 1.

The phallus receptacle 3 receives the phallus of the wearer in an upright posture so that the head of the phallus faces upwards. Also, there is provided a transverse elastic element 2 in the phallus receptacle 3 and at the entrance side of the phallus receptacle 3.

The scrotum nest 1 preferably protrudes from the front portion of the briefs to the extent that it does not press hard the scrotum inside. However, an excessive protusion of the nest 1 would deteriorate the briefs in esthetic sense while too small a protrusion of the nest 1 will disadvantageously press the scrotum against the wearer's body which is one of the problems of the prior art briefs.

Preferably, the porous material or net used for manufacturing the scrotum nest 1 has a mesh sufficiently fine that it gives a visual block and allows a good circulation of air therethrough. If a net having too fine net is used, the circulation of air is obstructed. On the other hand, an excessively loose net will cause an unsightly appearance of the privy parts of the wearer.

The phallus receptacle 3 is comprised of two layers of cloths which is similar to the front panel used in known briefs. As is well known, the typical briefs now in use has a two layer front panel which provides a urination passage or opening as well as a shield for normally preventing exposure of the male organ. However, the phallus receptacle of the present invention provides for the reception of the phallus between its two cloth elements.

The front portion of the briefs comprises an outer cloth panel or element 5, overlying and attached to an inner cloth panel or element 6 at four seams, namely, a waist seam 7, a lateral seam 8, a right leg seam **9*a* and a left leg seam 9*b*. The outer cloth element 5 is also attached to the top of the scrotum nest 1 at a bottom seam 10. The outer cloth element 5 is separated at its right end 11 from the inner cloth element 6 to provide a urination passage opening 12. The inner cloth element 6 is separated at its lower free end 13 from the outer cloth element 5 to provide an entrance 14 for the phallus to the receptacle 3 formed between the overlying outer cloth element 5 and inner cloth element 6**.

Figure 2:
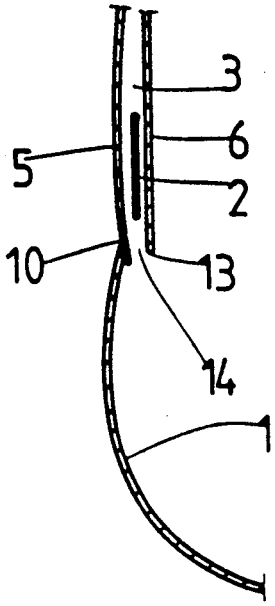
FIG. 2 is a longitudinal sectional view taken substantially along-line 2-2 of the briefs shown in FIG. 1.
Figure 3:
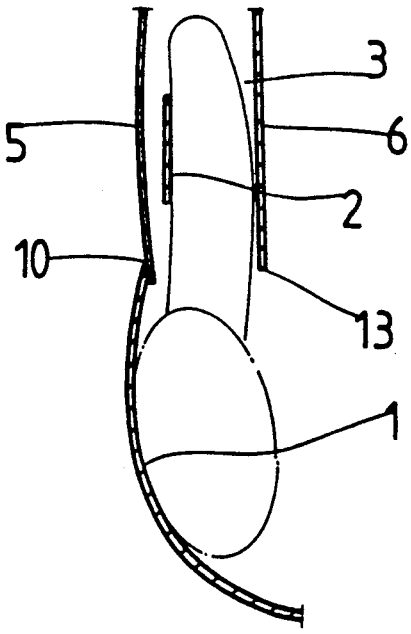
FIG. 3 illustrates the briefs of the present invention in operation.

The elastic band or element 2 is attached to the phallus receptacle 3 transversely inbetween the inner 6 and outer and inside 5 cloth elements as shown in FIG. 2 in order to prevent the phallus, which has been received in the receptacle 3 with its head portion facing upwards, from falling. The elastic element 2 preferably has a somewhat large width in order not to give undue stimulation to the phallus, and also has an elasticity such as not to give a stimulation to the phallus but enough to hold the phallus upright against a collapse thereof. The right end **15*a* of the elastic element 2 is attached to the inner cloth element 6 at the corresponding position of the right end 11 of the outer cloth element 5, and the left end 15*b* of the elastic element 2 is attached between inner cloth element 6 and outer cloth element 5 by the lateral seam 8**.

In operation, a male wears the briefs 4 with his scrotum placed in the scrotum nest 1 and his phallus inserted upright in the phallus receptacle 3 between the inner cloth element 6 of the front panel and the elastic element 2. This posture of the retained male organ advantageously separates the phallus and the scrotum from the adjacent skin areas, thereby preventing any moisture induced diseases including the moist tetter due to contacts between adjacent skin areas.

Additionally, the scrotum nest 1 made of a net material improves the circulation of air and maintains a fresh low temparature at the body parts, thus the phallus and the scrotum can always be kept dry. Of course, this provides feelings of cleanliness and freshness for the body.

At the time of urination, the phallus in an upright posture can be directly guided out of the briefs, from between the elastic element 2 and inner cloth element 6 of the phallus receptacle 3, and through the urination passage opening 12 thereof. This means that the presence of the phallus receptacle 3 only effects favorably to the wearer.

Although a preferred embodiment of the present invention has been diclosed for illustrative purpose, those skilled in the art will appreciate that various modifications, addition and substitution are possible, without departing from the scope and spirit of the invention as diclosed.

What is claimed is:

1. Male underwear having a body encircling member for enclosing a pelvic part of a male and including a waist band and front and back portions connected to the waist band, the front portion comprising:

an inner front panel means having an upper end portion, opposite lateral side portions, and a lower free end;

an outer front panel means having an upper end portion, opposite lateral side portions, and a lower end;

a scrotum nest of porous material connected to said lower end of said outer front panel means;

said outer front panel means overlying said inner front panel means with at least the respective upper end portions and respective one lateral side portions of said opposite lateral side portions connected together to form a phallus receptacle above said scrotum nest for receiving a phallus in an upright posture;

said lower free end of said inner front panel positioned behind and adjacent the connection of said scrotum nest to said lower end of said outer front panel means and forming an entrance of said phallus receptacle;

a transverse elastic band positioned between said inner front panel means and said outer front panel means above said entrance of said phallus receptacle, and having a first end connected between said one lateral side portions of said inner and outer font panel means, and having a second end connected to a second side portion of said opposite lateral side portions of said inner front panel means, thereby forming separate receptacles for the phallus and scrotum of the wearer to maintain them separated from contact with adjacent skin areas and allowing sufficient air circulation to prevent moisture induced diseases including moist tetter.

2. Male underwear as set forth in claim 1, in which said scrotum nest is made of a net material.

3. Male underwear as set forth in claim 1, including first and second leg opening means on said body encircling member, and said inner and outer front panel means connected together at said first and second leg opening means.

4. Male underwear as set forth in claim 1, in which said upper end portions of said inner front panel and said outer front panel are connected together at the waist band.

* * * * *